US010415915B2

(12) United States Patent
Sahin et al.

(10) Patent No.: US 10,415,915 B2
(45) Date of Patent: Sep. 17, 2019

(54) LOCK MECHANISM OF A TRIGGER GROUP THAT ENABLES ASSEMBLY AND DISASSEMBLY OF A GUN

(71) Applicant: RETAY SILAH OTOMOTIV INSAAT VE GIDA SANAYI VE TICARET LIMITED SIRKETI, Selçuklu, Konya (TR)

(72) Inventors: Adem Sahin, Konya (TR); Hasan Kepez, Konya (TR)

(73) Assignee: RETAY SILAH OTOMOTIV INSAAT VE GIDA SANAYI VE TICA, Konya (TR)

( * ) Notice: Subject to any disclaimer, the term of this patent is extended or adjusted under 35 U.S.C. 154(b) by 0 days.

(21) Appl. No.: 15/893,024

(22) Filed: Feb. 9, 2018

(65) Prior Publication Data

US 2019/0049208 A1 Feb. 14, 2019

(51) Int. Cl.
*F41A 19/00* (2006.01)
*F41A 19/10* (2006.01)
*F41A 19/15* (2006.01)

(52) U.S. Cl.
CPC ..... *F41A 19/10* (2013.01); *F41A 19/15* (2013.01)

(58) Field of Classification Search
CPC ..... F41A 19/10; F41A 19/15
USPC ..... 42/69.01
See application file for complete search history.

(56) References Cited

U.S. PATENT DOCUMENTS

| | | | | |
|---|---|---|---|---|
| 7,162,824 | B1 * | 1/2007 | McCormick | F41A 19/10 42/75.03 |
| 8,839,709 | B1 * | 9/2014 | Crye | F41A 9/74 89/157 |
| 9,046,313 | B1 * | 6/2015 | Lutton | F41A 17/46 |
| 2015/0198403 | A1 * | 7/2015 | Bentley | F41A 21/484 42/75.02 |
| 2017/0241731 | A1 * | 8/2017 | Ince | F41A 19/21 |
| 2017/0370666 | A1 * | 12/2017 | Foster | F41A 11/02 |

* cited by examiner

*Primary Examiner* — J. Woodrow Eldred
(74) *Attorney, Agent, or Firm* — Egbert Law Offices, PLLC

(57) ABSTRACT

A lock system which is included in shotguns that are used by hunters to hunt game animals, characterized in that it is developed to provide safety storage by disassembling the trigger group from the case when the gun is not used and to provide the trigger group to be easily mounted on the case when the gun is used. This provides easy assembly and disassembly procedures of the trigger group on the case via a lock bolt gap, a contact surface and a locking point created on the case belonging to the gun. A stop gap, fitting surface, lock bolt gap, vertical surface, assembly gap, positioning gap and operating gap are created on the trigger guard of the trigger group. A lock bolt contacted with a cap pin extends through the assembly gap by positioning in the lock bolt gap created on the trigger group.

7 Claims, 7 Drawing Sheets

LOCK MECHANISM OF A TRIGGER GROUP THAT ENABLES ASSEMBLY AND DISASSEMBLY OF A GUN

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The invention relates to shotguns that are used by hunters to hunt an animal.

Specifically, the invention relates to a lock system which is included in shotguns that are used by hunters to hunt game animals, developed to provide safety storage by disassembling when the gun is not used and to provide easily mounting on the case when the gun is used; this provides easy assembly and disassembly procedures of the trigger group on the case via:

- a lock bolt gap and a contact surface created on the case belonging to the gun;
- a stop gap, a fitting surface, a locking point, an assembly gap, vertical surface, a positioning gap and an operation clearance created on the trigger group;
- a lock bolt contacted with a capped pin through the assembly gap by positioning in the lock bolt gap created on the trigger group.

2. Description of Related Art Including Information Disclosed Under 37 CFR 1.97 and 37 CFR 1.98

Shotguns are used by hunters for hunting game animals. A screw or pin is used for assembly and disassembly procedures of the trigger group in the case of shotguns. After the trigger group is positioned to the case, the screw is tightened, or mounting is provided the pin by getting through so as to fix screw or pin. In that kind of usage, assembly and disassembly procedures are rather inconvenient. Therefore, a hunter usually disassembles the trigger group from the case during the cleaning process of shotguns. In the external cases, the trigger group is not disassembled from the shotgun.

In the cases that shotguns are not used, and safety latch is forgotten to be pulled if there is safety latch, a few disadvantages such as pulling trigger group of a shotgun may be encountered. In these cases, shotgun goes off and damages to the creatures in the surrounding.

Besides apart from the disadvantage stated above, shotguns are kept in the houses except hunting. The gun is not disassembled during the storage process. A gun, which is not disassembled, creates a risk, especially for kids. The reason is that a kid may handle a gun for playing. In the cases where there is no cartridge in the chamber and safety latch is unlocked by a kid, the kid may shoot other people in the surrounding.

Negativities were experienced during normal usage or storage of shotguns used in the background art explained above.

Consequently, it is necessary that related technical field is developed because of the negativities stated above and encountered in the background art.

BRIEF SUMMARY OF THE INVENTION

Due to existing negativities in the background art, the invention aims to overcome all negativities described.

The objective of the invention is to provide a lock system which is developed to provide safety storage by disassembling when the shotgun used by hunters for hunting game animals is not used and to provide easily mounting of the trigger group on the case when the gun is used; this provides easy assembly and disassembly procedures of the trigger group (200) on the case (100) via:

- the lock bolt gap, contact surface and locking point created on the case belonging to the gun;
- the stage gap, fitting surface, lock bolt gap, assembly gap, vertical surface, positioning gap and operating gap created on the trigger group;
- the lock bolt contacted with the capped pin through the assembly gap by positioning in the lock bolt gap created on the trigger group.

Another objective of the invention is to provide the trigger group to be kept externally by disassembling from the case in cases where the gun is not used. Thus, the trigger group can be easily disassembled from the case of the gun and it can be mounted again. Therefore, it is provided to prevent the gun from firing and to eliminate the accidents that may be experienced in situations where the kids play with a gun.

REFERENCE NUMBERS

Figure 1:
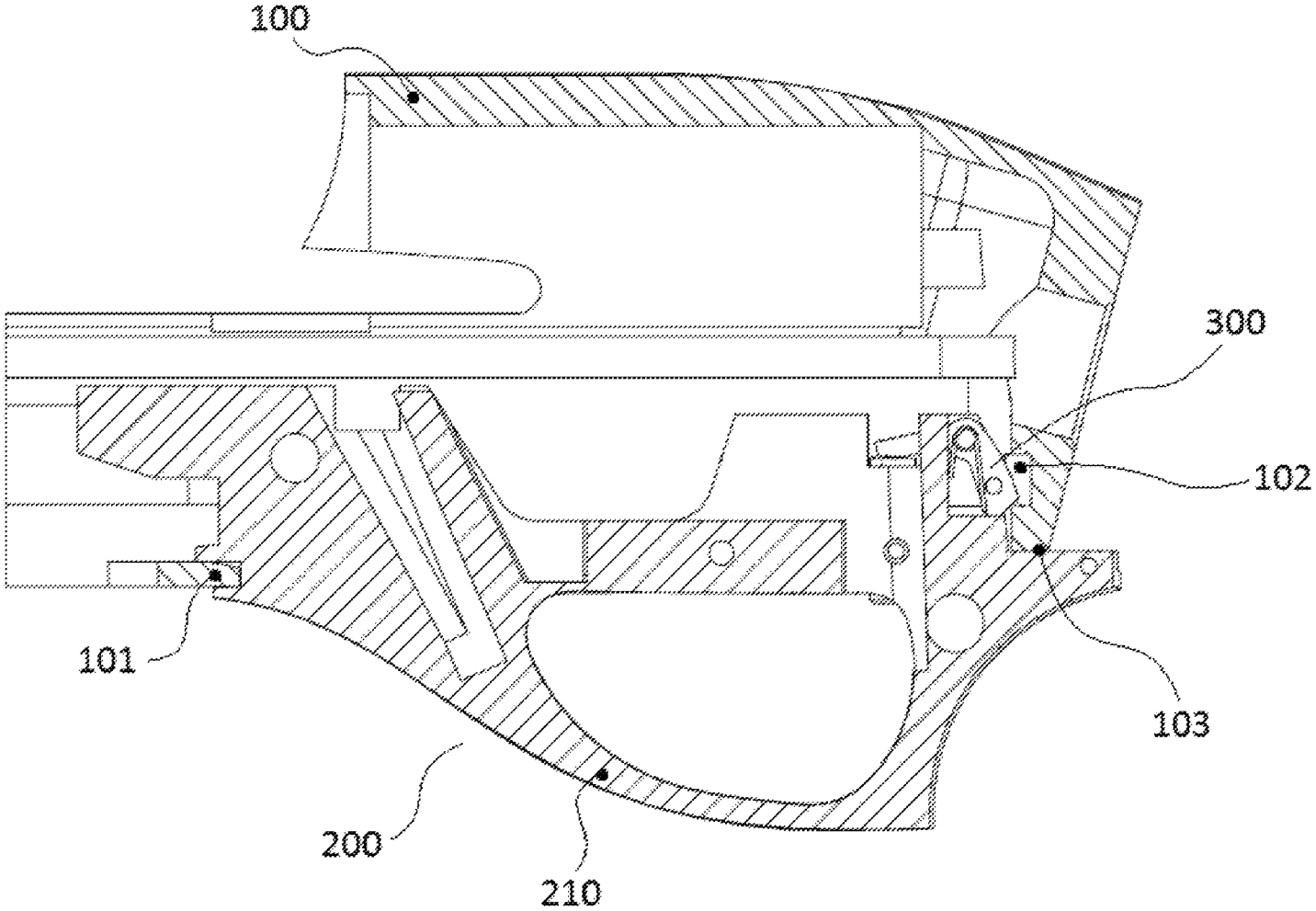
FIG. 1 is a representative mounted and sectional side view of the case, trigger group and lock system, which is the topic of the invention.
Figure 2:
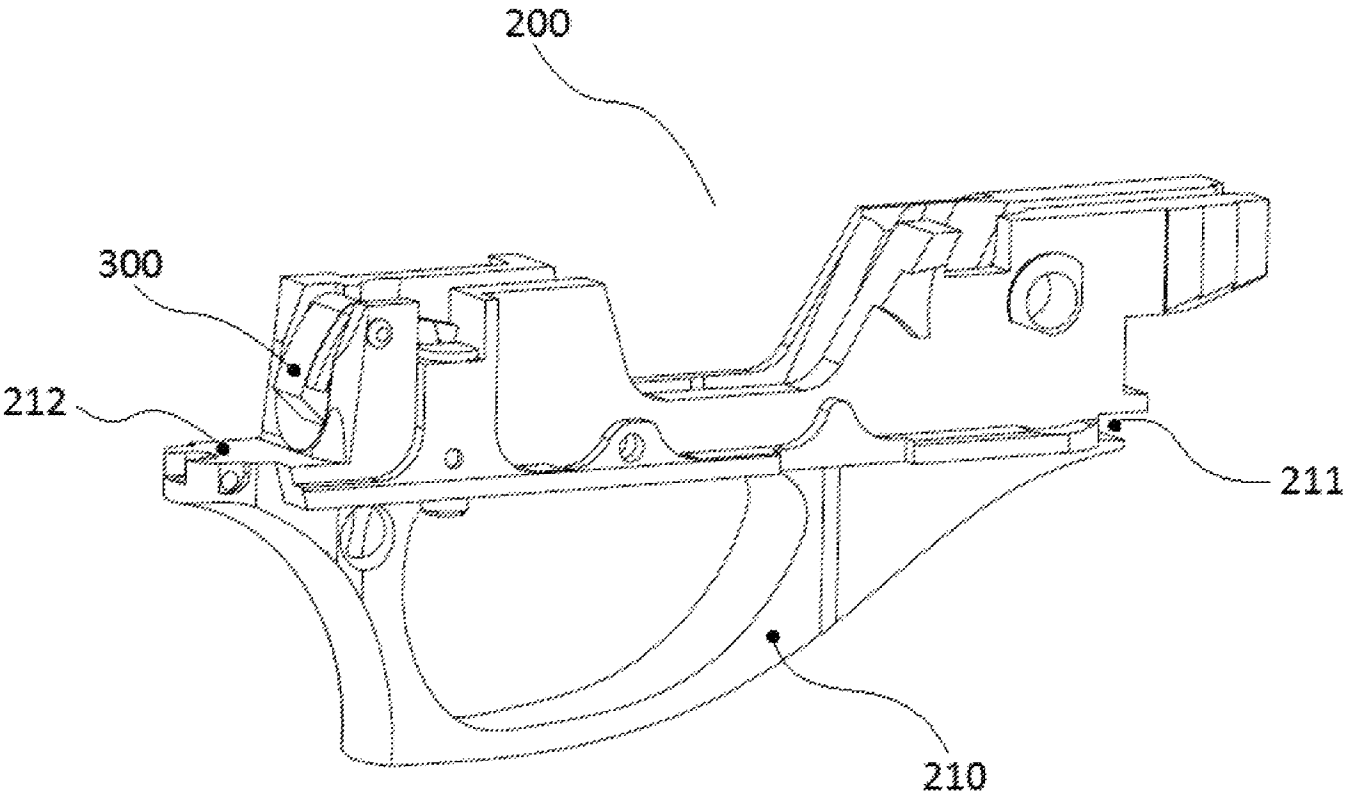
FIG. 2 is a representative perspective view of a lock system, which is the topic of the invention, mounted to the trigger group from a different angle.
Figure 3:
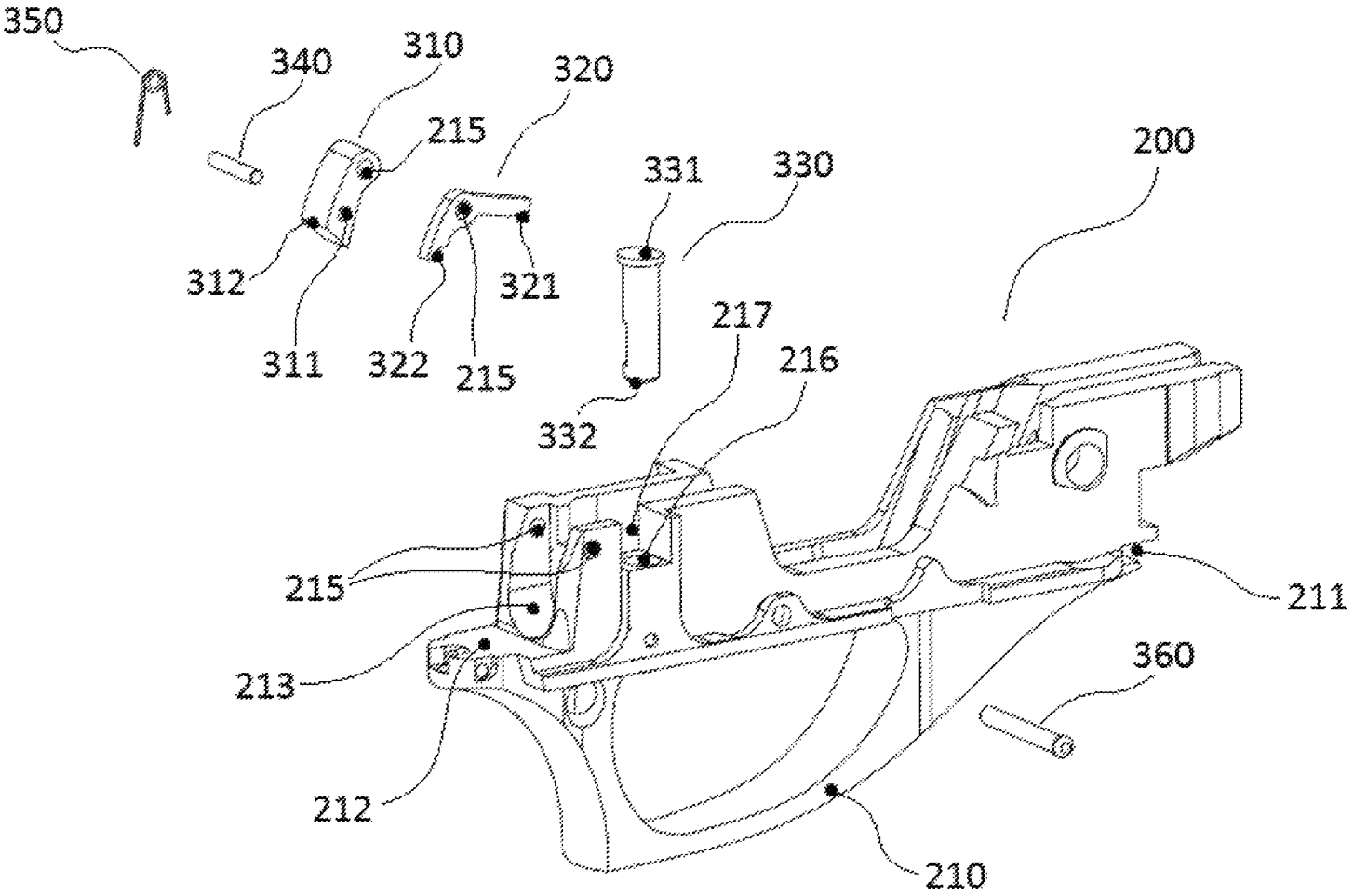
FIG. 3 is a representative perspective view of a lock system, which is the topic of the invention, disassembled from the trigger group from a different angle.

100. Case
101. Stop
102. Lock bolt gap
103. Contact surface
104. Locking point
200. Trigger group
210. Trigger guard
211. Stop gap
212. Fitting surface
213. Locking point
214. Vertical surface
215. Assembly gap
216. Positioning gap
217. Operating gap
300. Lock system
310. Lock bolt
311. Pin gap
312. Lock rim
320. Intermediate member
321. Lower pressure surface
322. Side pressure surface
330. Lock switch
331. Upper surface
332. Subsurface
340. Pin
350. Sear spring
360. Capped pin

DETAILED DESCRIPTION OF THE INVENTION

FIG. 1 is a mounted and sectional side view of the case (100) belonging to a shotgun used by hunters to hunt game animals, and the trigger guard (210) belonging to the trigger group (200) and lock system (300), which is the topic of the invention.

During the production process of the invention developed for providing safety storage by disassembling the trigger group (200) through the case (100) in cases where the gun is not used and for mounting the trigger group (200) on the receiver (100) when the gun is used:

lock bolt gap (102), the contact surface (103) and locking point (104) were created in the case (100); and stop gap (211), fitting surface (212), lock bolt gap (213), vertical surface (214), assembly gap (215), positioning gap (216) and operating gap (217) were created on the trigger guard (210) of the trigger group (200).

The lock system (300), which provides for easy assembly and disassembly of the trigger group (200) on the case (100) via lock bolt (310) contacted with capped pin (360) extending through the assembly gap (215) by positioning to the lock bolt gap (213) created on the trigger guard (210) belonging to the trigger group (200), consists of:

assembly gap (215), pin clearance (311) and lock rim (312) located on lock bolt (310), intermediate member (320) found on assembly gap (215), surface (321) and side pressure surface (322), lock switch (330) having an upper surface (331) and a subsurface (332), pin (340) connected with pin gap (311) found in lock bolt (310), sear spring (350) enabling the lock bolt (310) or lock system (300) to be in the forward position, thus to be active by means of stretched position, capped pin (360) providing the connection of the lock system (300) with the trigger guard (210).

In the mounting process of the lock system (300) to the trigger guard (210), lock switch (330) is positioned to the positioning gap (216) on the trigger guard (210) so as to move the upper part of the lock system on the operating gap (217). Cap pin (360) is mounted by extending through the assembly gap (215) after the intermediate member (320), lock bolt (310) and sear spring (350) concerning the lock system (300) are positioned on the lock bolt gap (213). At this stage, the lock system (300), since one end point of the sear spring (350) contacts with the vertical surface (214) and another end point of the sear spring contacts with the pin (340) on the lock bolt (310), the lock bolt (310) is pushed forward, thus the lock system (300) is in the locking position.

Figure 4:
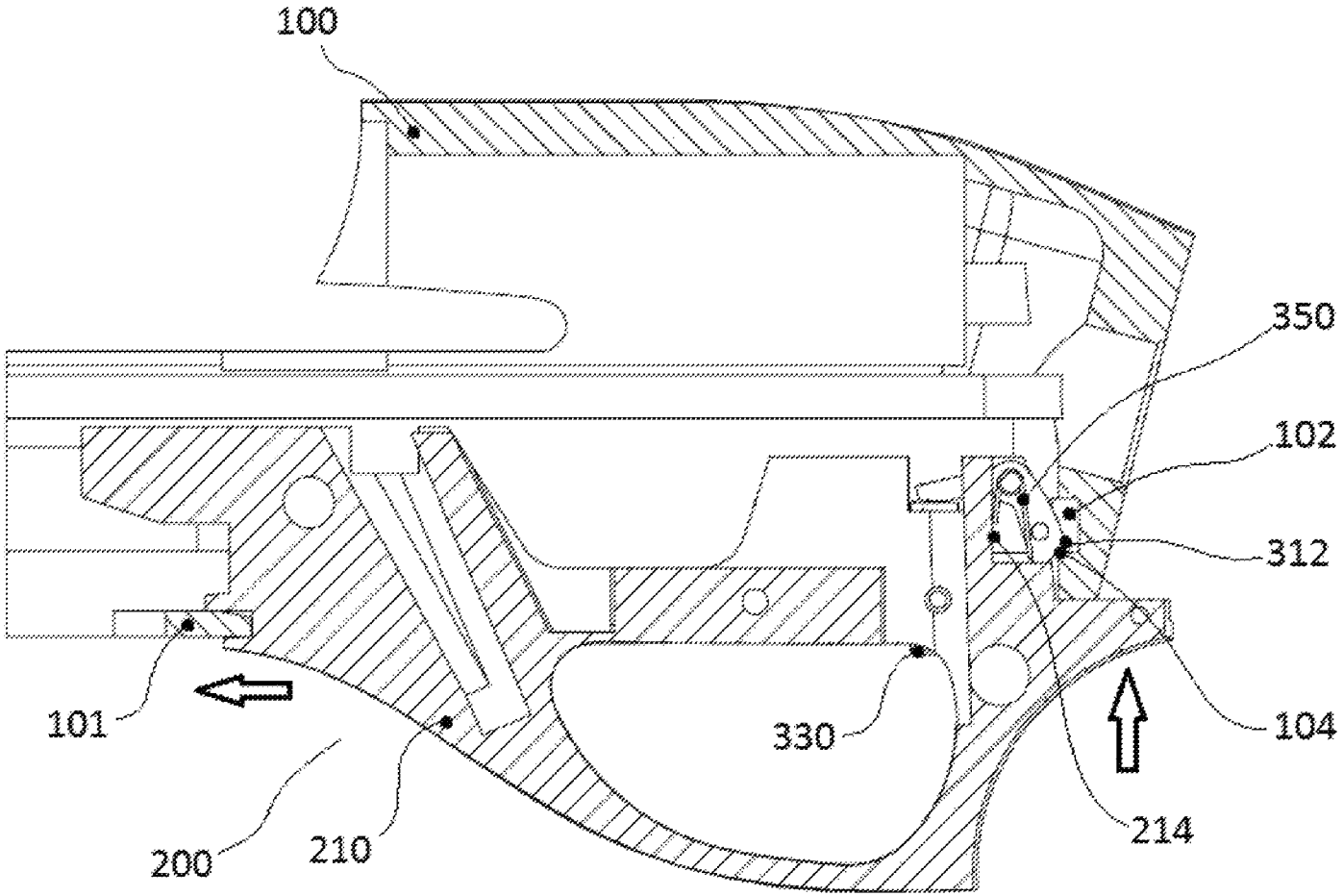
FIG. 4 is a representative left sectional view of the trigger group mounted on the case and has active lock system.
Figure 5:
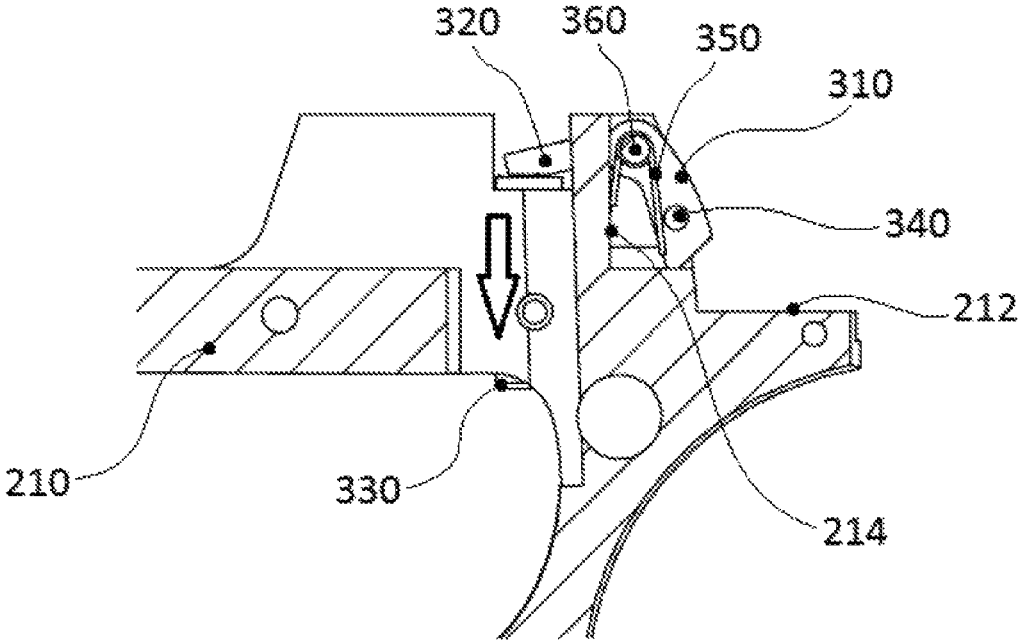
FIG. 5 is a representative left sectional detailed view of the lock system mounted on the trigger group, showing the activated mode of the lock system.
Figure 6:
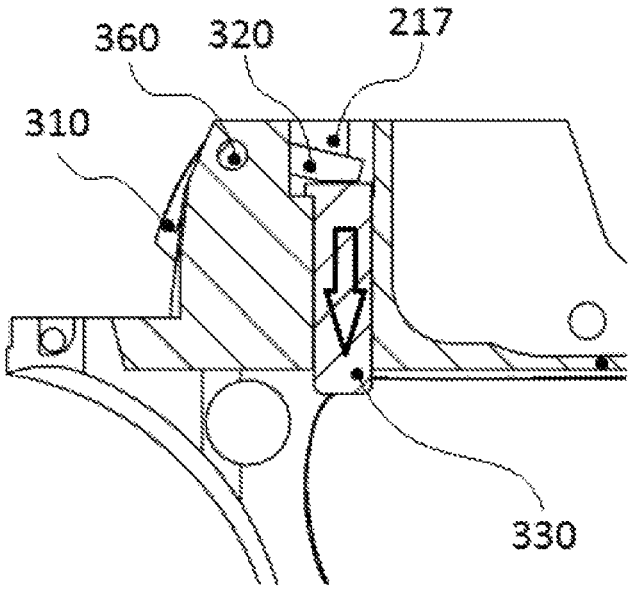
FIG. 6 is a representative right sectional detailed view of the lock system mounted on the trigger group, showing the activated mode of the lock system.

Mounting of the trigger guard (210) to the receiver (100) through the lock system (300) which is the topic of the invention is provided as shown in FIG. 4. In this process, stop gap (211) on the trigger guard (210) is screwed to the stop (101) on the receiver (100). Later, locking point (312) is provided to screw through the lock bolt gap (102) by overcoming the power of the sear spring (350) of the lock bolt (310) after the trigger guard (210) is pushed upward to the case (100). At the same time, the lock rim (312) presses the locking point (104). At this point, fitting surface (212) on the trigger guard (210) contacts with the contact surface (103) on the case (100), locking is enabled, and the gun is now ready to use.

Figure 7:
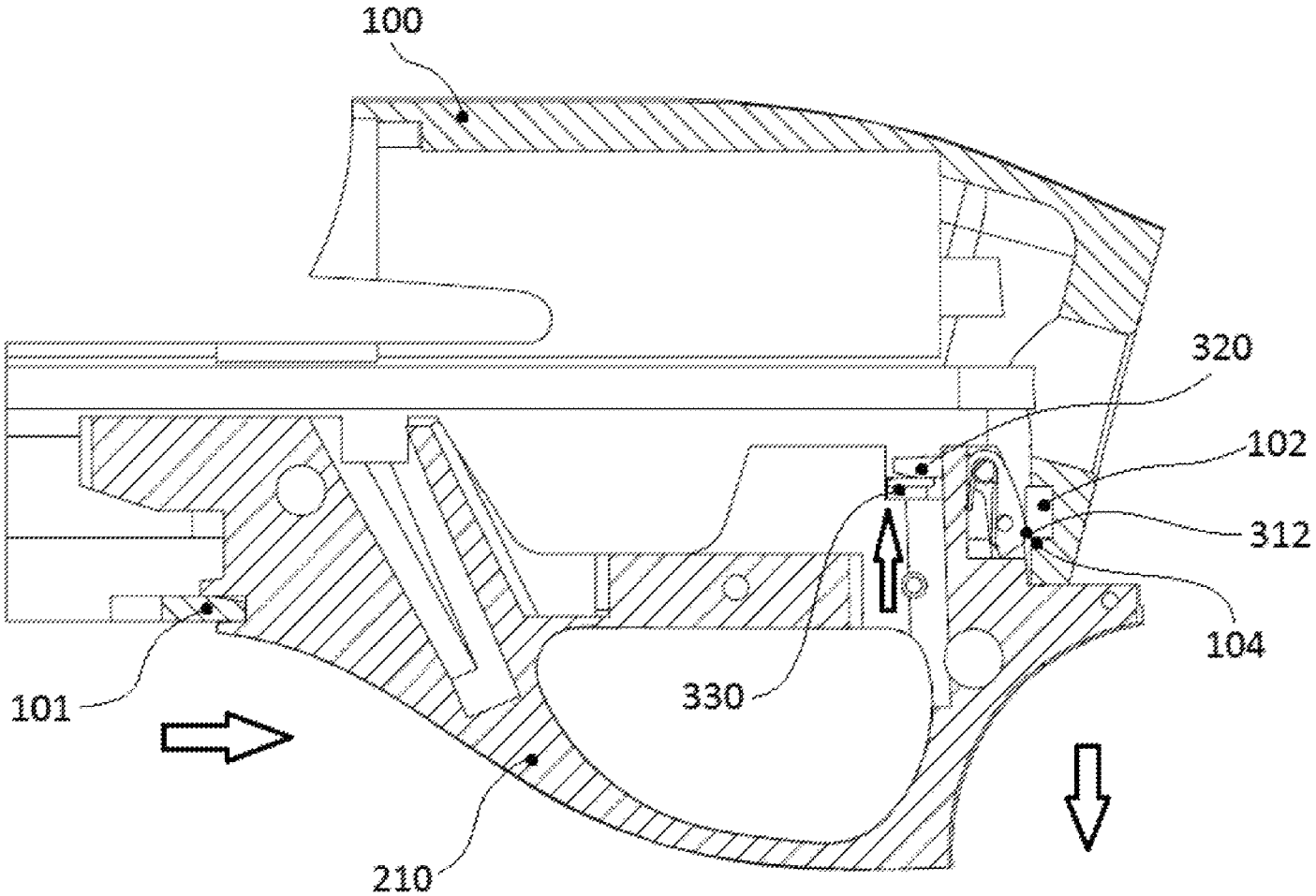
FIG. 7 is a representative left sectional view of the lock system mounted on the trigger group with deactivated lock system.
Figure 8:
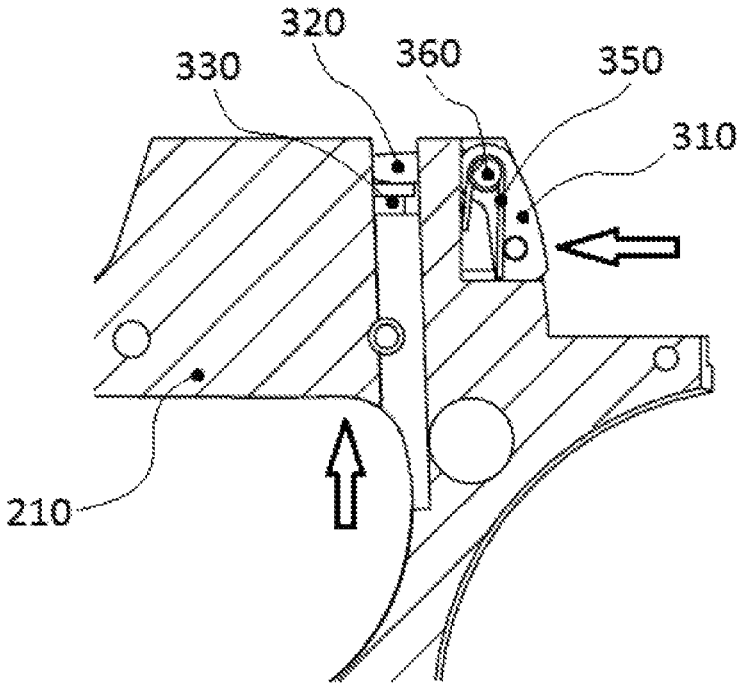
FIG. 8 is a representative left sectional detailed view of the lock system mounted on the trigger group, showing the deactivated mode.
Figure 9:
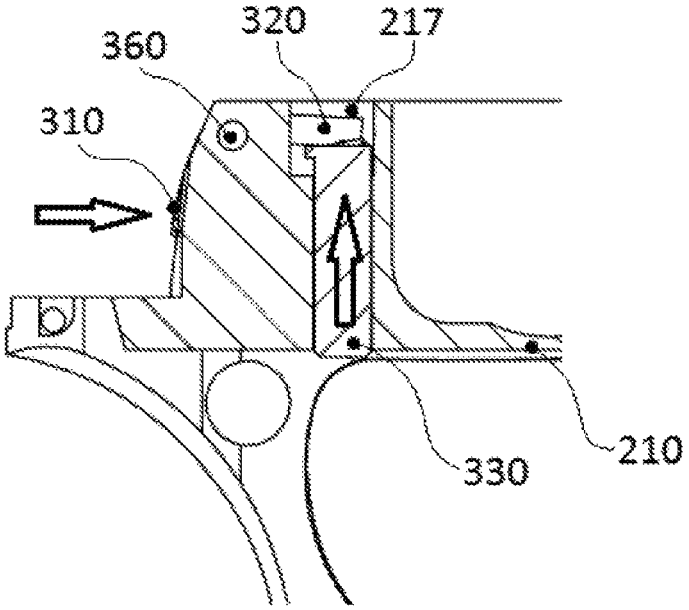
FIG. 9 is a representative right sectional detailed view of the lock system mounted on the trigger group, showing the deactivated mode.

The trigger group (200) must be disassembled from the case (100) to eliminate accidental risk in the cases where the gun is not used. This process, which includes the disassembly of the trigger group (200) from the case (100), is shown representatively in FIG. 7.

In the process specified, the hunter pushes the lock switch (330) by pushing it from the subsurface (332) upward. Intermediate member (320) contacts with the lower pressure surface (321) to the upper surface (331) of the lock switch (330) moving through the operating gap (217) moves around the axis of the cap pin (360) and therefore, it pushes the pin (340) on the lock bolt (310) via side pressure surface (322). As a result of the movement of the pin (340), the lock bolt (310) is enabled to be disassembled from the lock rim (312) thus, lock bolt gap (102) by overwhelming the sear spring (350). In this case, the trigger guard (210) is moved to the bottom, stop guard (211) is separated from the stop (101), so the trigger group (200) is easily disassembled from the case (100).

By means of the lock system (300) which is the topic of the invention, the trigger group (200) can be kept by easily disassembling from the case (100) in cases where the gun is not used as stated above. Therefore, it was provided to prevent the gun from firing and to eliminate the accidents that may be experienced in situations where the kids play with a gun.

We claim:

1. A lock system for a gun, the lock system comprising:

a case having a lock bolt gap, a contact surface, a locking point and a stop;

a trigger group cooperative with said case such that said trigger group is disassembleable from said case when the gun is not in use and such that said trigger group is assembleable when the gun is to be used, the trigger group comprising:

a trigger guard:

a lock bolt pivotally mounted to said trigger guard, said lock bolt being selectively receivable in said lock bolt gap, said lock bolt having a lock protrusion therein, said locking point passing over said lock protrusion when said trigger group is assembled on said case;

a fitting surface extending outwardly of said trigger guard, said contact surface contacting against said fitting surface when said trigger group is assembled on said case;

a stop gap receiving said stop of said case;

a lock bolt gap extending upwardly from said trigger guard said lock bolt being positioned in said lock bolt gap;

a vertical surface positioned adjacent said lock gap;

a sear spring bearing against said vertical surface and said lock bolt;

an assembly gap receiving a capped pin, said capped pin securing the lock bolt in said trigger guard;

a positioning gap into which a lock switch is inserted; and an operating gap cooperative with an upper part of said lock switch.

2. The locking system of claim 1, wherein said lock protrusion of said lock bolt contacting said assembly gap and with said locking point when said trigger group is assembled on said case.

3. The locking system of claim 1, further comprising:

an intermediate member having said assembly gap therein;

a lower pressure surface contacting the upper part of said lock switch; and a side pressure surface cooperative with said lock bolt so as to release said lock bolt by applying pressure to a pin connected to said lock bolt.

4. The locking system of claim 3, said lock switch being controlled manually, said lock switch having an upper surface contacting said lower pressure surface within said intermediate member, said lock switch having a lower pressure surface which is manually operable.

5. The locking system of claim 3, the pin of said lock bolt being connected to a pin gap within said lock bolt.

6. The locking system of claim 3, said sear spring being stretchable by contact with the pin of said lock bolt and with contact with said vertical surface and with said lock bolt, said sear spring urging said lock bolt forwardly.

7. The locking system of claim 4, said capped pin insertable into said assembly gap, said lock bolt and said intermediate member.

* * * * *